United States Patent [19]

Takamatsu

[11] 3,956,799

[45] May 18, 1976

[54] CONCEALED SLIDING CLASP FASTENERS

[75] Inventor: Ikuo Takamatsu, Uozu, Japan

[73] Assignee: Yoshida Kogyo K.K., Japan

[22] Filed: Dec. 27, 1974

[21] Appl. No.: 536,998

[30] Foreign Application Priority Data

Dec. 28, 1973 Japan ..... 49-491593[U]

[52] U.S. Cl. ..... 24/205.1 C; 24/205.13 C

[51] Int. Cl.[2] ..... A44B 19/10; A44B 19/40

[58] Field of Search ..... 24/205.1 C, 205.13 C, 24/205.16 C

[56] References Cited

UNITED STATES PATENTS

| | | | |
|---|---|---|---|
| 3,336,640 | 8/1967 | Chery | 24/205.13 C |
| 3,691,599 | 9/1972 | Maisenbacher | 24/205.13 C |
| 3,855,672 | 12/1974 | Takamatsu | 24/205.1 C |

FOREIGN PATENTS OR APPLICATIONS

| | | | |
|---|---|---|---|
| 1,032,554 | 6/1966 | United Kingdom | 24/205.1 |

*Primary Examiner*—Bernard A. Gelak

*Attorney, Agent, or Firm*—Bucknam and Archer

[57] ABSTRACT

An interlocking fastener element for use in a concealed type of sliding clasp fastener is formed from a filamentary member into a modified meander structure. This structure is made up from a row of meandering clasps or scoops, part of each of which clasps is flattened out to provide increased areas of the element for engagement both with a fastener support tape and with a slider.

3 Claims, 2 Drawing Figures

CONCEALED SLIDING CLASP FASTENERS

BACKGROUND OF THE INVENTION

This invention relates to sliding clasp fasteners and more particularly to interlocking fastener elements for concealed or masked sliding clasp fasteners.

There are known various forms of concealed sliding clasp fastener elements made of a filamentary member of plastics material which is formed into a coil or meander structure. Such fasteners have found wide use on closure-openings in garments such as for example dresses and skirts. Due to being uniform in thickness and round in cross-section, the filamentary fastener elements of the prior-art have been responsible for a rather bulky appearance of a complete sliding clasp fastener. This is objectionable from the point of view of the merits of a concealed fastener, makes a garment attached with such fastener look awkward, and furthermore hinders the comfort of wear of the garment.

Being round in cross section throughout its length, the known fastener element row would after all fail to be retained in position when subjected to severe external stresses applied as by a reciprocating slider.

SUMMARY OF THE INVENTION

In view of the foregoing difficulties of the prior art, it is a primary object of this invention to provide an improved interlocking fastener element formed from a filamentary plastics material for use on a concealed sliding clasp fastener, the overall thickness of which fastener element as seen in end view is reduced to a minumum so that the fastener can be readily applied to such garments as dresses and skirts with utmost satisfaction.

Another object of the invention is to provide an improved interlocking fastener element having such structural features which will permit the element to be affixed to a fastener support tape with high stability so as to ensure smooth and stable coupling and uncoupling operation of the fastener.

Briefly stated, the interlocking fastener element for a concealed sliding clasp fastener according to the invention comprises a filamentary member formed from a plastics or similar pliable material into a modified meander structure consisting of a row of longitudinally aligned clasps, each of which clasps includes a coupling head, upper and lower shanks extending rearwardly from said coupling head, a bridge portion extending between and connecting two adjacent upper shanks, a clamping portion extending from said lower shank and a link portion extending between and connecting two adjacent clamping portions, the fastener element being reduced in thickness throughout a region of each clasp extending from said lower shank up to said link portion.

The features which are believed to be novel and characteristic of this invention are set forth with particularity in the appended claims. The invention itself, however, will be better understood from the following description taken in conjunction with the accompanying drawings which illustrate by way of example a specific embodiment which the invention may assume in practice.

DETAILED DESCRIPTION OF THE PREFERRED EMBODIMENT

As will be understod from a consideration of the drawings, there is provided in accordance with the invention as interlocking fastener element 10 for use on a concealed sliding clasp fastener generally designated at F, which fastener element is formed from a filamentary plastics or similar pliable material into a modified meander structure. This structure includes a row of longitudinally aligned clasps or scoops 11 for mounting on and along one longitudinal edge of a fastener support tape T. Each clasp 11 includes a coupling head 11*a*, upper and lower shanks 11*b* and 11*c* extending rearwardly from the coupling head 11*a*, a bridge portion 11*d* extending between and connecting two adjacent upper shanks 11*b* and a clamping portion 11*e* extending from the lower shank 11*c*.

Figure 1:
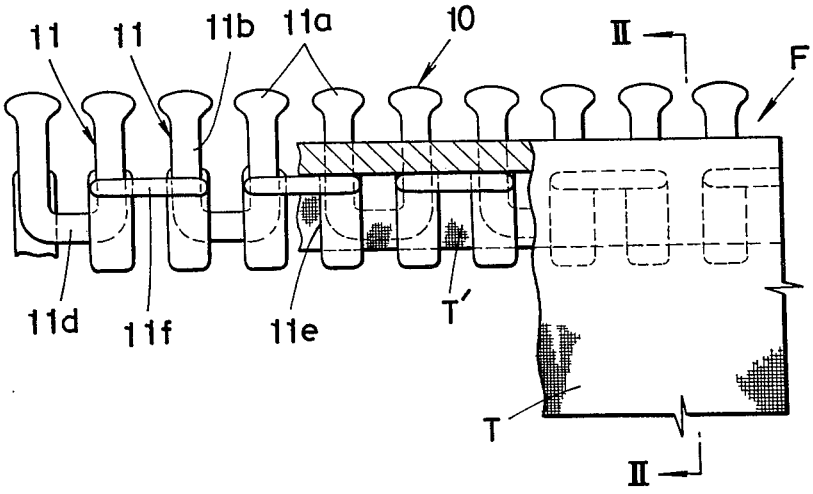
FIG. 1 is a plan view of a concealed sliding clasp fastener half partly broken away, illustrating an interlocking element structure provided in accordance with the invention.
Figure 2:
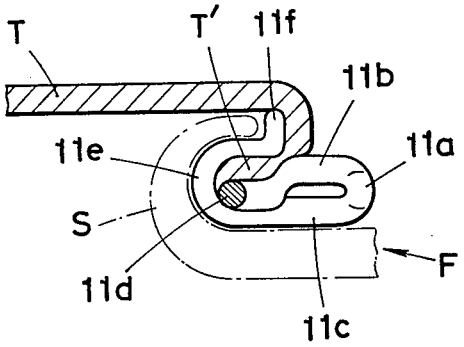
FIG. 2 is a cross-sectional view taken along the line II—II of FIG. 1.

It will be seen from FIG. 1 that the upper and lower shanks 11*b* and 11*c* are superimposed upon one another when seen in projection to the plane of the fastener F and that the clamping portion 11*e* in one clasp is interconnected by a link portion 11*f* to that in the neighboring clasp. The link portion 11*f* rises substantially upright from the clamping portion ll*e*, as better shown in FIG. 2, and serves to keep a clearance between the lower surface of the tape T and the clamping portion 11*e* of the fastener element 10 for the passage of a slider S. The fastener element 10 is mounted on the tape T with a marginal tape edge T′ folded around the link portion ll*f* and clamped between the clamping portion 11*e* and the upper shank 11*b*, as better seen in FIG. 2.

According to an important feature of the present invention, the thickness of the filamentary element 10 is reduced throughout a region of each clasp 11 extending from part of the lower shank 11*c* up to the link portion 11*f*. This is accomplished by flattening out the filament at that region, as will be understood from a reference to FIG. 2 wherein part of the lower shank 11*c* is seen projecting sidewise of the superposed upper shank 11*b* and the link portion 11*f* appears thinner than the remaining portions of the clasp 11. The resulting fastener element 10 provides a relatively low profile for the fastener on which it is mounted, as to achieve the primary object of the invention above stated. As a result of flattening or otherwise reducing the thickness of the crosssectionally round filamentary element 10, there is provided increased area of the element 10 for contact with the slider S so that the clasps 11 can be stably interlocked without rolling out of place during the closing and opening movement of the slider S. The area of the clamping portion 11*e* is also enlarged in the longitudinal direction of the tape T so that the fastener element 10 can be mounted on and secured with greater stability to the tape T.

What is claimed is:

1. An interlocking fastener element for a concealed sliding clasp fastener which comprises a filamentary member formed into a meander structure having a continuous row of longitudinally aligned clasps, each of said clasps including a coupling head, an upper shank and a lower shank both connected to and extending from said coupling head in superposed spaced-apart relation, a bridge portion extending longitudinally and connecting the upper shank of the clasp to the upper shank of an adjacent clasp, a clamping portion connected to and extending from said lower shank, said clamping portion being U-shaped to partially enclose said bridge portion and a marginal edge of a support tape on which the fastener element is mounted, and a link portion extending longitudinally and connecting the clamping portion of the clasp to the clamping portion of an adjacent clasp, said fastener element being reduced in thickness throughout a region of each clasp extending from part of said lower shank up to said link portion.

2. An interlocking fastener element as defined in claim 1 wherein said link portion rises substantially upright from said clamping portion in a direction perpendicular to the plane of said marginal edge of the support tape.

3. An interlocking fastener element as defined in claim 1 wherein said region of each clasp is flattened out.

* * * * *